United States Patent [19]

Toyomura et al.

[11] 4,152,983

[45] May 8, 1979

[54] PRINTING HAMMER DRIVING SYSTEM

[75] Inventors: Shigeru Toyomura; Hiroshi Kyogoku, both of Kawasaki; Mitsuaki Seki, Tokyo, all of Japan

[73] Assignee: Canon Kabushiki Kaisha, Tokyo, Japan

[21] Appl. No.: 845,373

[22] Filed: Oct. 25, 1977

Related U.S. Application Data

[63] Continuation of Ser. No. 692,016, Jun. 1, 1976, abandoned.

[30] Foreign Application Priority Data

Jun. 9, 1975 [JP] Japan ..... 50-69329

[51] Int. Cl.[2] ..... B41J 1/32

[52] U.S. Cl. ..... 101/93.23; 101/93.29

[58] Field of Search ..... 101/93.09, 93.29–93.34, 101/93.23, 93.48; 178/23; 317/137; 364/900

[56] References Cited

U.S. PATENT DOCUMENTS

| | | | |
|---|---|---|---|
| Re. 26,240 | 7/1967 | Wasserman | 101/93.09 |
| 2,776,618 | 1/1957 | Hartley | 101/93.23 |
| 3,088,401 | 5/1963 | Shimabukuro | 101/93.29 |
| 3,322,064 | 5/1967 | Sims | 101/93.23 |
| 3,589,282 | 6/1971 | King | 340/146.2 X |
| 3,848,527 | 11/1974 | Nihorn | 101/93.23 |
| 3,855,923 | 12/1974 | Foley | 340/172.5 X |
| 3,872,789 | 3/1975 | Ambrosil | 101/93.29 |

*Primary Examiner*—Edward M. Coven

*Attorney, Agent, or Firm*—Fitzpatrick, Cella, Harper & Scinto

[57] ABSTRACT

In a printing hammer driving system, there is provided a character-bearing member having a plurality of identical characters disposed in mutually offset relationship in each of lines. The characters in each of the lines differ from those in any other line. A group of hammers is disposed in opposed relationship with the character-bearing member for impacting the characters thereon. A group of driving circuits is connected to the group of hammers for driving respective ones of the hammers. A group of gates is connected to the inputs of the group of driving circuits for selecting the hammers. Each of the gates has at least two input terminals. Memory means are provided which each have the output thereof connected to one of the input terminals of each gate for storing print digit information. Selector means are provided which each are connected to the other input terminal of each gate for selecting one or more of the gates.

7 Claims, 9 Drawing Figures

FIG. IB

PRINTING HAMMER DRIVING SYSTEM

This is a continuation of application Ser. No. 692,016 filed June 1, 1976, now abandoned.

BACKGROUND OF THE INVENTION

1. Field of the Invention

This invention relates to a printer hammer driving system, and more particularly to a system suitable for driving hammers disposed in opposed relationship with a character drum or belt carrying thereon characters of the same kind offset with respect to one another.

2. Description of the Prior Art

In these years, developments of various printing techniques have given the advent of numerous character drums carrying thereon characters of the same kind offset with respect to one another. This is attributable to various reasons including the desire for uniform quality of printed characters, economy of the driving circuits, etc.

SUMMARY OF THE INVENTION

The present invention intends to provide a very advantageous system for driving the printing hammers for the character drum carrying thereon characters of the same kind offset with respect to one another.

According to the present invention, the printing hammer driving system comprises a character-bearing member having a plurality of identical characters disposed in mutually offset relationship in each of lines, the characters in each of the lines being different from those in any other line. A group of hammers is disposed in opposed relationship with the character-bearing member for impacting the characters thereon. A group of driving circuits is connected to the group of hammers for driving respective ones of the hammers. A group of gates is connected to the inputs of the group of driving circuits for selecting the hammers, each of the gates having at least two input terminals. Memory means are provided, each of which has the output thereof connected to one of the input terminals of each of the gates for storing print digit information. Selector means are provided, each of which is connected to the other input terminal of each of the gates for selecting one or more of the gates.

The memory means may each comprise a first portion for storing of the print digit information and a second portion for storing part of such information.

The plurality of identical characters in the same one of the lines on the character-bearing member may be disposed with one or more digit spacing in the direction parallel to the axis of rotation of the character-bearing member and offset by a unit pitch in the direction perpendicular to the axis of rotation.

Alternatively, the plurality of identical characters in the same one of the lines on the character-bearing member may be disposed with continuous digit spacing in the direction parallel to the axis of rotation of the character-bearing member and offset by a unit pitch in the direction perpendicular to the axis of rotation.

The invention will become more fully apparent from the following detailed description thereof taken in conjunction with the accompanying drawings.

DESCRIPTION OF THE PREFERRED EMBODIMENTS

Figure 1:
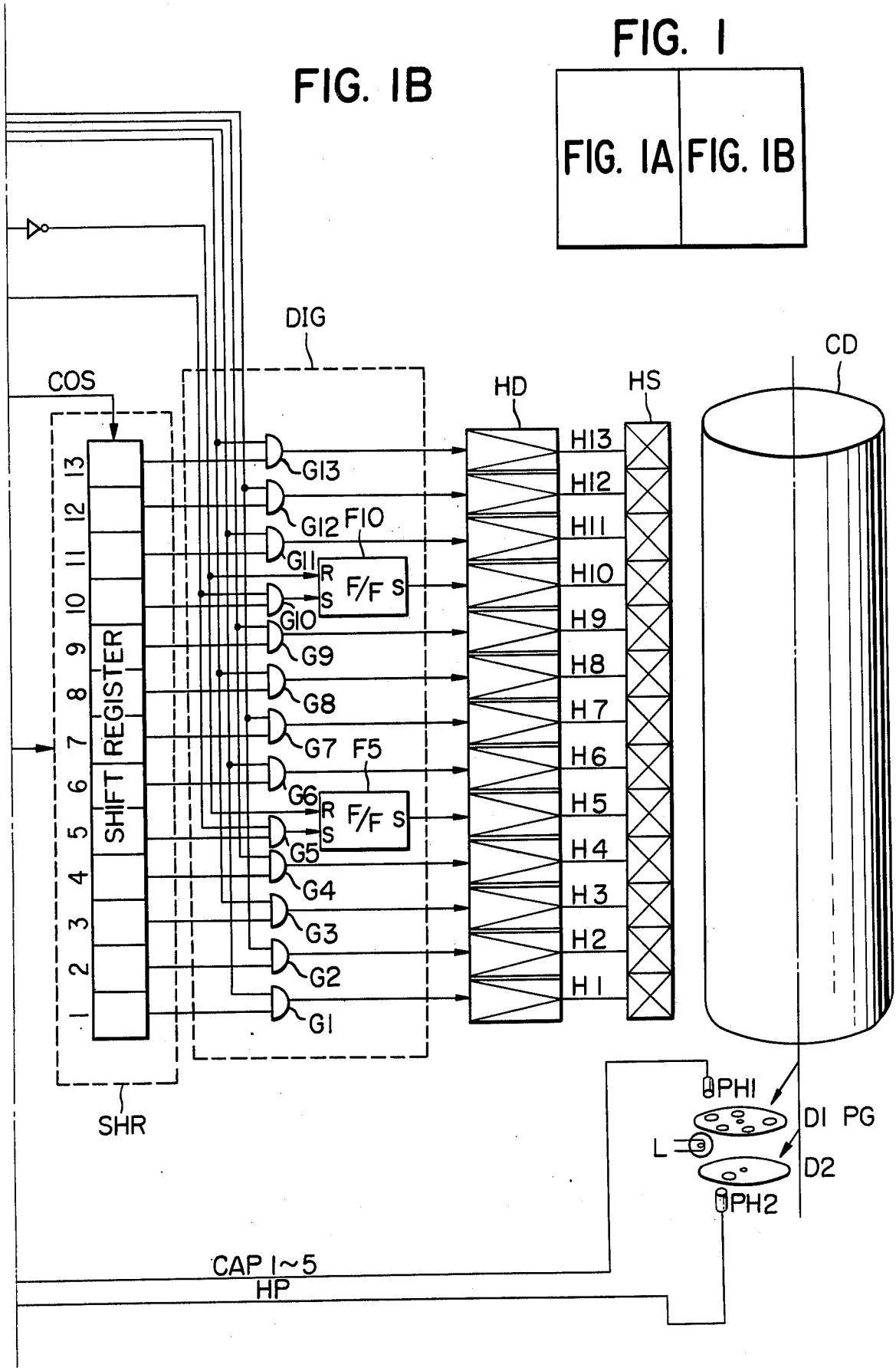
FIG. 1 diagrammatically shows an embodiment of the present invention.
Figure 1A:
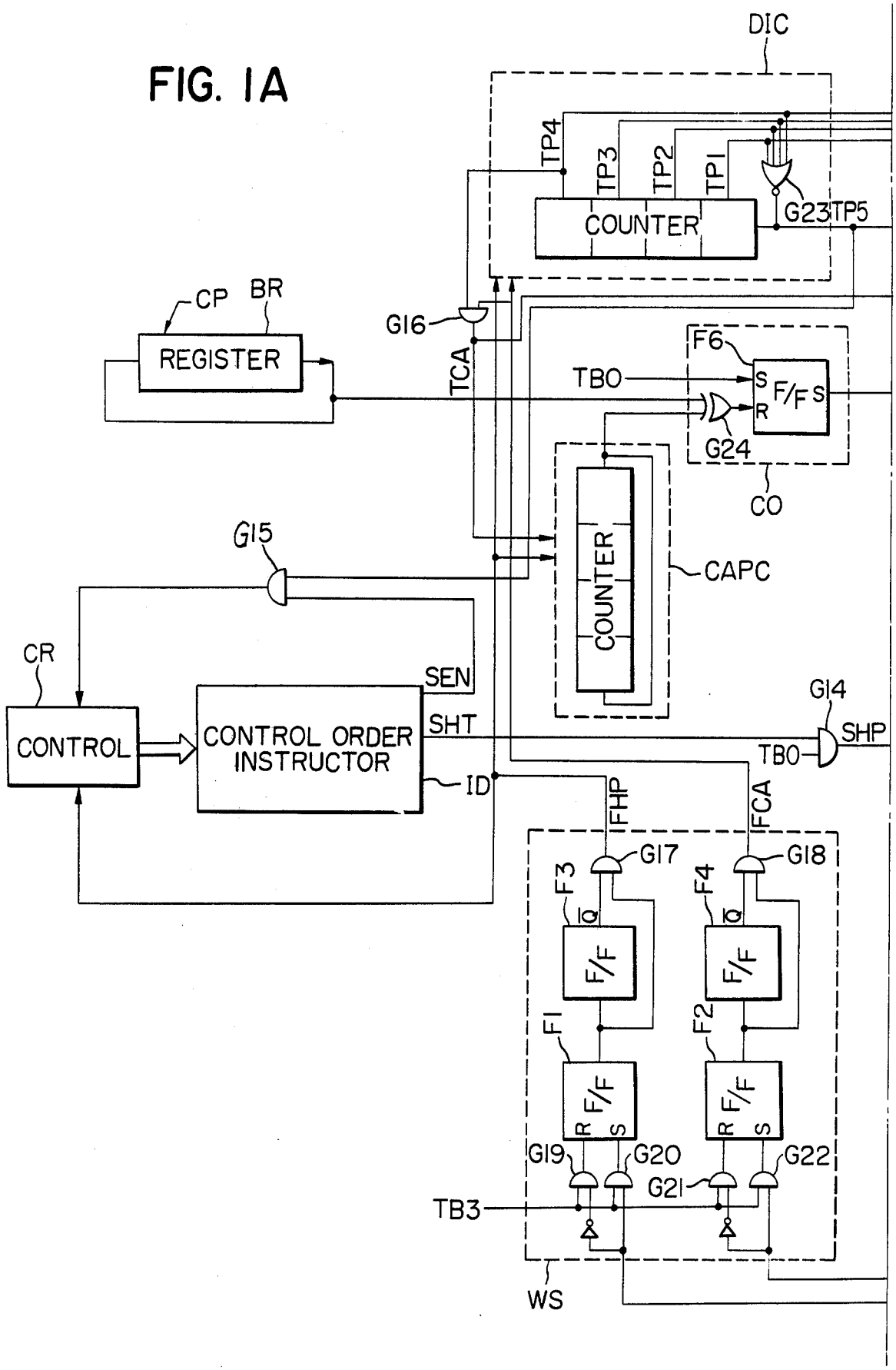
Figure 2A:
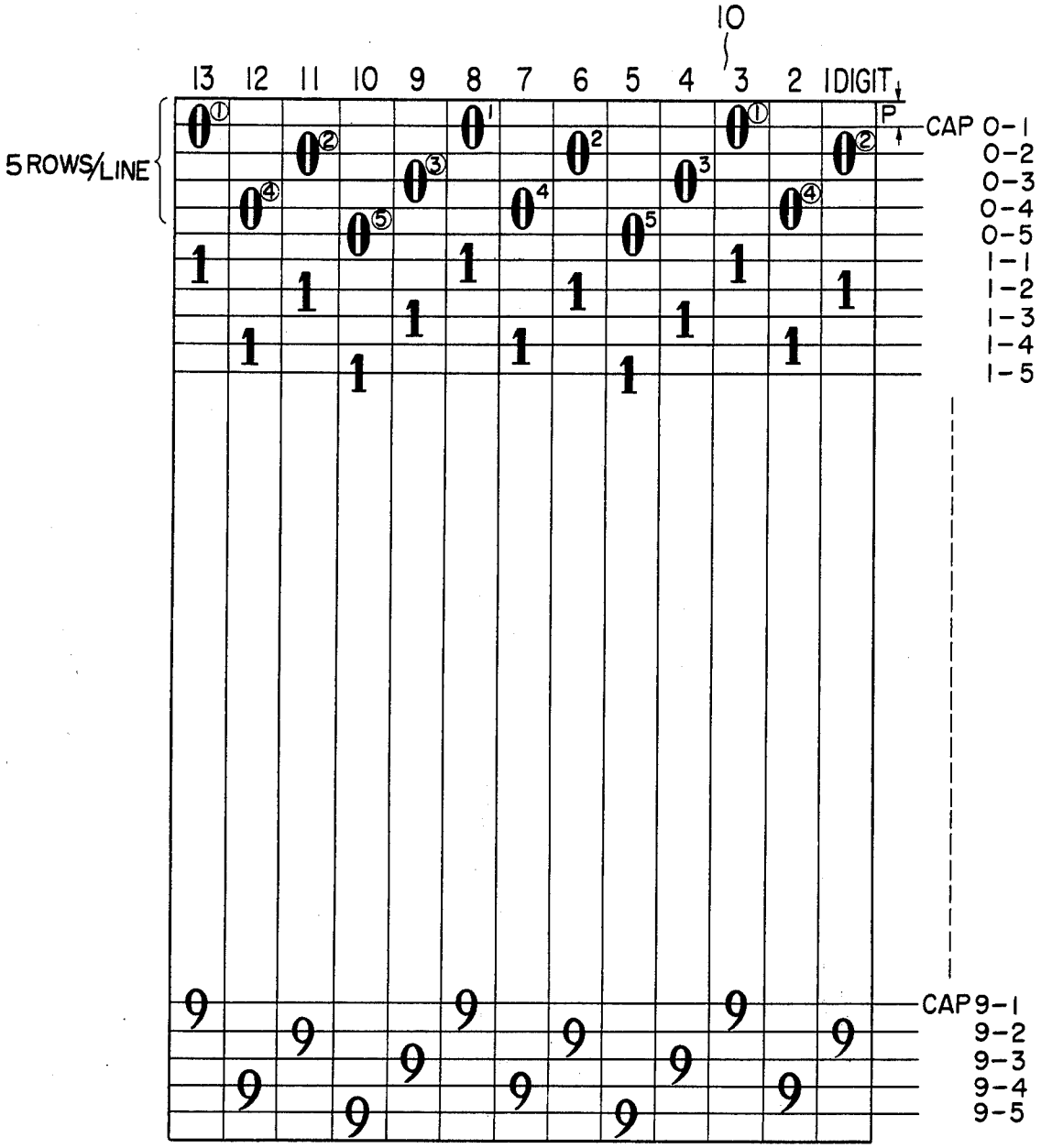
FIG. 2(A) shows an example of the character drum used in FIG. 1.

Referring to FIG. 1, it is a block diagram showing an embodiment of the present invention. The basic construction and operation thereof is disclosed in Published Japanese Patent Application No. 103127/1973. In the Figure, CD designates a character drum having a group of characters arranged on the surface thereof in the manner as shown in FIG. 2(A). The character drum CD is synchronized with character pulse CAP.

HS denotes hammer solenoids for selectively impacting the characters on the character drum. Designated by HD are driving circuits for energizing the hammer solenoids HS.

PG is a timing pulse generator D1 represents a distributor formed with a group of holes corresponding to the number of rows per line of identical characters on the character drum (in the example of FIG. 2(A), five rows per line), and rotating by one complete rotation each time the character drum CD rotates by an amount corresponding to one line.

Figure 3:
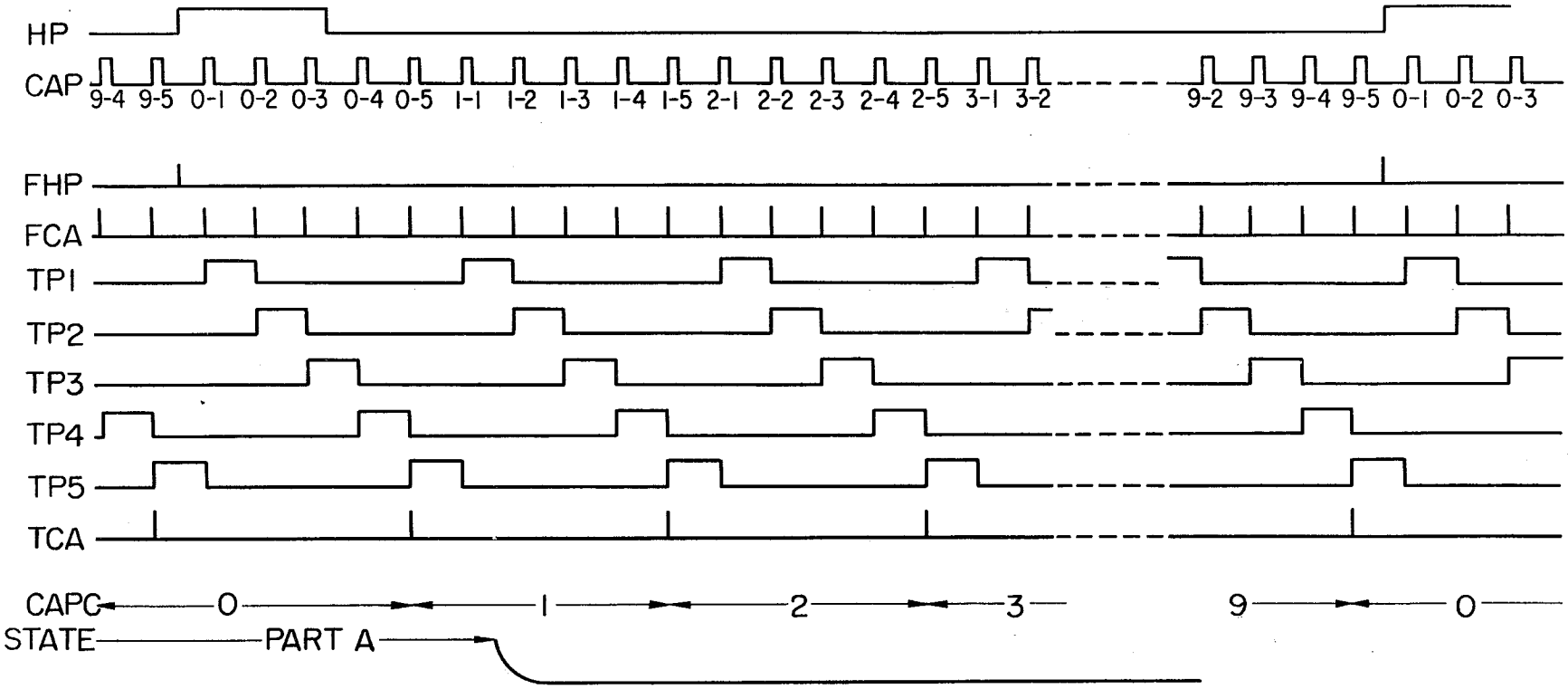
FIGS. 3, 4 and 5 are timing charts for illustrating the operation of the FIG. 1 embodiment.

Photoelectric converter elements PH1 and PH2 detect the light from a lamp L to respectively produce character pulses CAP corresponding to the position of the rows per line of characters and a home pulse HP for detecting one period of the character drum, in the manner as shown in FIG. 3. Designated by BR is a 14-digit circulating register which may store a maximum thirteen digits of numerical data to be printed.

Designated by WS is a waveform shaping circuit for the character pulses CAP which are the signals from the timing pulse generator PG and the home pulse HP, and this circuit shapes these pulses into the rising 1-bit width and produces signals FCA and FHP. DIC is a ring counter which, in the present circuit arrangement, comprises a 4-bit Johnson counter. This 4-bit Johnson counter counts the FCA pulse to thereby put out five pulses TP1–TP5 in succession and produces the time durations for five divisions.

The DIC is designed such that TP1–TP4 are reset and TP5 is set, both by the pulse FHP.

Designated by CAPC is a 4-bit character pulse counter which, if there are ten different characters, may count pulse TCA, which corresponds to one of the five character pulse CAP, in the decimal fashion to thereby memorize the line on which the character drum is then positioned, thus detecting the character line position.

This character pulse counter is reset by the shaping pulse FHP for home pulse HP generated each time the character drum has made one complete rotation.

Designated by CO is a coincidence circuit which may, at each four bits, compare the character line position memorized by the character pulse counter CAPC with the numerical data to be printed in the circulating register BR and if these are coincident, may put out a coincidence detection signal COS.

A static shift register SHR is provided to receive the coincidence detection signal COS.

DIG comprises a group of gate flip-flops for time-dividing the output from the static shift register SHR by the output of the ring counter DIC and delivers the time-divided output to the hammer solenoid driving circuit. DIG pertains to the essential part of the present invention.

Designated by CR is a control unit for the above-described circuit and comprises ROM (read-only memory) and a group of gate flip-flops. It is designed to store the data for controlling the shift of the shift register SHR and deliver such data successively to a control order instructor ID. The control order instructor ID decodes the data from the CR unit to thereby classify them into various orders and deliver such orders. By the control of this circuit, two orders are delivered, namely, shift order SHT and sense order SEN.

Reference will now be had to FIG. 3 to describe the operation of the printer driving circuit of the present invention constructed as described above.

It is to be understood that the 14-digit circulating register BR already stored, in predetermined ones of its digit places, numerical data to be printed.

Since the distributors D1 and D2 are rotated in synchronism with the character drum, the photoelectric converter element PH1 or PH2 receives the light from the lamp L through the group of holes in the distributor D1 or D2, to thereby generate a pulse.

The five character pulses CAP are generated each time the character drum rotates by an amount corresponding to five rows of one line and thus, a total of fifty pulses is generated for one complete rotation of the character drum having characters 0 to 9.

The home pulse HP for detecting one complete rotation of the character drum rises after generation of the character pulse CAP9-5 corresponding to the last line on the character drum.

The pulse FHP having the rising 1-bit width for the home pulse HP resets the character pulse counter CAPC to "0" and further resets TP1–TP4 of the ring counter DIC, thus setting TP5.

At the time of printing, sense order SEN is delivered from the ID unit. This is an order for sensing whether the output TP5 of the ring counter is "1" or not, and is detected by the gate G15 and sent to the CR unit. Upon receipt of such order, the CR unit generates the shift order SHT only once. This shift order SHT is synchronous with one period of the circulating register BR.

Now, when the signal TP5 has been detected by the order SEN, the order SHT is put out and the gate G14 is thereby opened so that a signal TBϕ, which is a pulse generated only once for 4 bits, is put out as the shift pulse SHP for the shift register. When this occurs, the character counter CAPC has "0" stored therein and encodes the numerical data "0" and delivers it to the coincidence circuit CO. In this condition, the numerical data stored in the circulating register BR is also delivered to the coincidence circuit CO, which thus effects comparison for each digig (4 bits). When coincidence is detected, namely, when the numerical data in the circulating register BR is "0", the coincidence circuit CO produces and applies a coincidence detection signal COS to the most significant digit place in the shift register SHR. In the coincidence circuit, the 4-bit numerical data in the circulating register BR and the data in the CAPC are compared in series for each bit, and the coincidence result is stored in the flip-flop F6 which gives preference to reset. Thus, the coincidence detection result is delivered as the coincidence detection signal to the shift register SHR during the time TBϕ which is the first bit time of the next digit after the 4-bit comparison has been effected, so that the coincidence detection signal for the most significant digit in the circulating register BR is not stored in the shift register SHR.

In this manner, the content "0" in the character counter and the numerical data stored in the circulating register are sequentially compared and detected by the coincidence circuit for all the digits except the most significant digit in the circulating register, and if the result of detection is "0", coincidence detection signal COS is delivered and the one-line print output content is stored in the shift register SHR.

With the rotation of the character drum, the output state of the DIC unit is shifted from TP5="1" to TP1="1" by the pulse CAP 0-1 corresponding to the "0" print position which is the first line on the character drum. As a result, in the DIG unit, the gates G13, G8 and G3 for the thirteenth, eighth and third digit places are opened and, if coincidence detection results are stored in the respective digit places, these gates drive the HD unit and energize the hammer solenoids.

In this manner, the DIC unit drives the eleventh, sixth and first column places in the state of TR2="1" by the subsequent CAP 0-2, the ninth and fourth column places in the state of TP3="1" by CAP 0-3, and the twelfth, seventh and second column places in the state of TP4="1" by CAP 0-4, respectively.

By the character pulse CAP 0-5, the state of TP5=1" is brought and this state is detected by the gate G16 to generate a pulse TCA. This TCA pulse is counted by the character counter CAPC, whereby the state of this counter is incremented from "0" to "1". Also, by the pulse TCA, the contents in the tenth and fifth digits places of the shift register SHR are stored in the flip-flops F10 and F5 to drive the hammer driving circuits HD. Thus, the content of the shift register SHR is no longer related to the print output, so that it may be replaced by the content of the next line. In other words, when the order SEN is put out during the last time duration TR5="1", this is detected and the order SHT is delivered as already noted, whereafter the numerical data of "1" in the character counter CAPC and the numerical data in the circulating register BR are compared and the coincidence detection result which is the output content for the next one-line is stored in the shift register SHR.

By the coincidence detection result being so stored in the shift register SHR within the time during which the last solenoid should be driven, the hammer solenoid may be driven at high speed in synchronism with the character pulse CAP.

Thus, as the character drum in rotated, five character pulses are generated for each line and five hammer impacts complete the printing of one character. As the content in the character counter changes successively from 0 to 9 for each line, the data stored in the circulating register are all checked up for each digit plate and, as is conventional, the coincidence of such data with the content in the character counter is taken out and stored in the shift register SHR.

Figure 4:
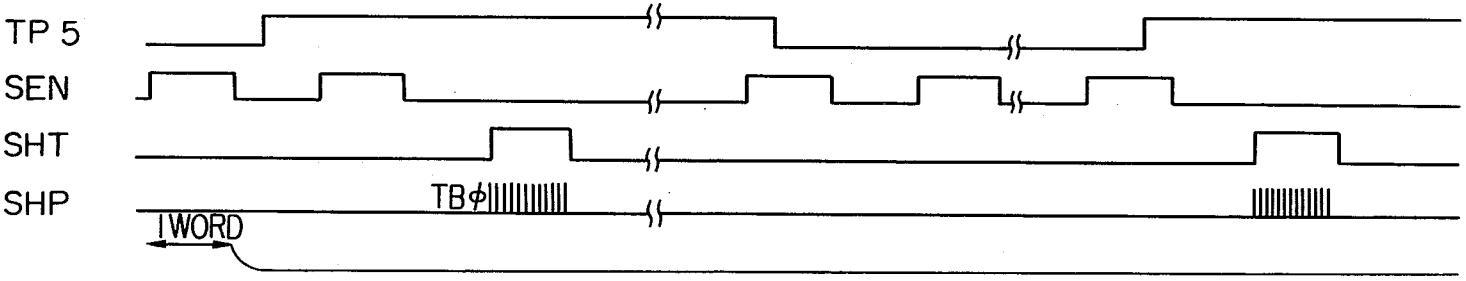
Figure 5:
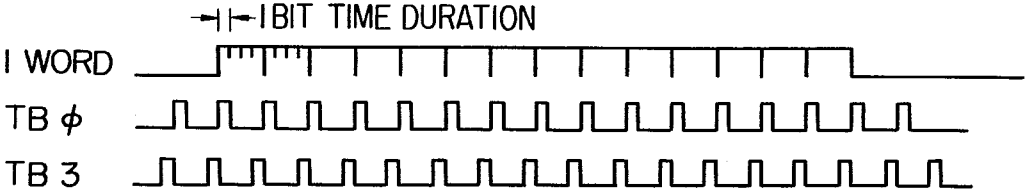

FIG. 4 is an enlarged time chart corresponding to the portion A of FIG. 3, and FIG. 5 is a timing chart illustrating one period of the circulating register BR, i.e. one-word time, and the basic pulses TBϕ and TB3.

Figure 2B:
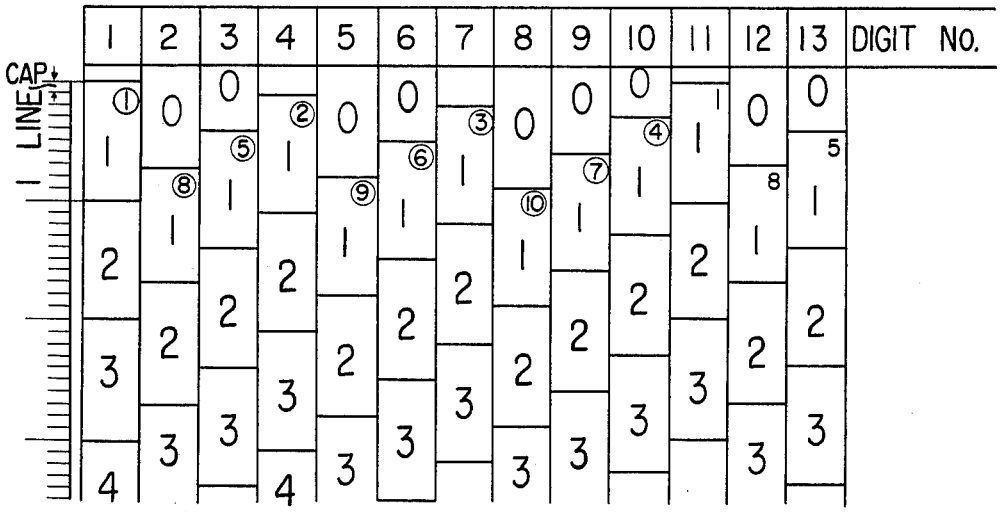
FIGS. 2(B) and (C) show further examples of the character arrangement.
Figure 2C:
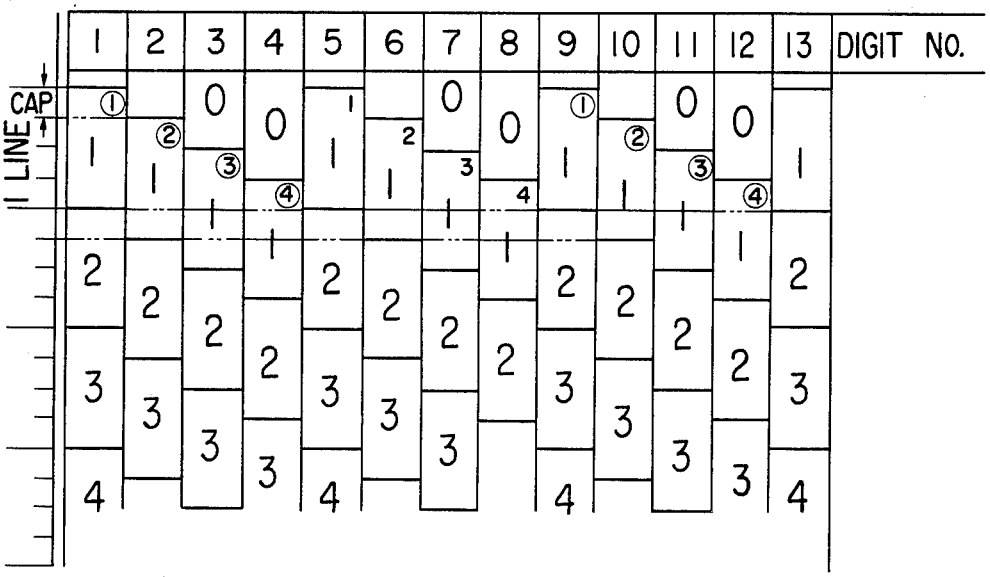

FIGS. 2(B) and (C) show further examples of the character arrangement. In the arrangement of FIG. 2(A), each line is divided into five rows and identical characters are disposed at every other digit place and mutually offset by a unit pitch P in the axial direction of the character drum, whereas in FIG. 2(B), each line is divided into ten rows and identical characters are disposed at every two digit places and mutually offset by a unit pitch P. In FIG. 2(C), each line is divided into four rows and identical characters are mutually offset by a pitch P continuously in the axial direction of the character drum. All these arrangements are suitable to carry out the present invention. In the case of the FIG. 2(B) arrangement, the two flip-flops F5 and F10 in FIG. 1 may be replaced by a single flip-flop provided in the eighth digit place. In the case of the FIG. 2(C) arrangement, flip-flops are only required in the fourth, eighth and twelfth digit places. With such construction, it is possible to reduce the time required from the detection of character pulse till the complete preparation for the printing. When very quickly responsive hammers are used, thus, there may be provided a printer device which may prevent any misprint which would otherwise result from delayed response of the hammers and which may achieve high speed and uniform quality of printing.

We claim:

1. A printer comprising:

a type drum having types disposed on its outer periphery so that the types of a like character are staggered to assume different positions spaced circumferentially along the surface of the drum;

a plurality of printing hammers provided oppositely to the types on said type drum;

a group of hammer drivers for driving said plurality of hammers;

a group of AND gates, each having two input terminals and a single output terminal, each of the output terminals being connected to one of said hammer drivers;

a series-input and parallel-output type of shift register having a single input terminal and a plurality of output terminals for storing coincidence signals as printing digit information on selected of said hammers, each of the plurality of output terminals being connected to one of the two input terminals of said respective AND gates;

selector means connected to the other of the input terminals of said AND gates for selecting the staggered types of a like character on the drum;

means including a wave shaper for producing character pulses corresponding to the rotation of said type drum;

a character pulse counter connected to receive and count the character pulses to produce a resultant count;

storage means for storing a plurality of digits of printing information;

a single coincidence circuit responsive to the printing digit information from said storage means and the count from said character pulse counter for comparing the printing digit information digit by digit with the count of said character pulse counter to produce, upon coincidence therebetween, a coincidence signal and for applying each such coincidence signal to the single input terminal of said shift register while shifting the contents of said shift register upon each digit comparison; and a controller responsive to said selector means for enabling said shift register to store and shift the coincidence signals as the printing digit information.

2. A printer in accordance with claim 1, wherein inputs of different ones of said AND gates are connected in groups with each group of AND gate inputs being energized in sequence by said selector means and flip-flops are connected between the AND gates of the last to be energized of said groups and said hammer drivers and settable to activate the associated hammer drivers whereby said controller may cause said shift register to shift the printing digit information of a succeeding printing line during a period of time while said flip-flops are set to activate the associate hammer drivers.

3. A printer in accordance with claim 1, wherein the types of a like character on the drum disposed so as to be staggered to assume different positions spaced circumferentially along the surface of the drum are arranged with a unit pitch provided therebetween, the length of the unit pitch being so short as to make two adjacent ones of the types of a like character interleaved.

4. A printer comprising:

a type drum having types disposed on its outer periphery so that the type of a like character are staggered to assume different positions spaced circumferentially along the surface of the drum with a unit pitch provided therebetween, the length of the unit pitch being so short as to make two adjacent ones of the types of a like character interleaved;

a plurality of printing hammers provided oppositely to the types of said type drum;

a group of hammer drivers for driving said plurality of hammers;

a group of AND gates, each having two input terminals and a single output terminal, each of the output terminals being connected to one of said hammer drivers;

a serial-input and parallel-output type of shift register having a single input terminal and a plurality of output terminals for storing coincidence signals as printing digit information for selection of said hammers, each of the plurality of output terminals of said shift register being connected to one of the two input terminals of said respective AND gates;

selector means connected to the other of the input terminals of said AND gates for selecting the staggered types of a like character on said type drum;

a character pulse counter connected to receive and count character pulses associated with rotation of said type drum to produce a resultant count;

storage means for storing a plurality of digits of printing information;

a single coincidence circuit responsive to the printing digit information from said storage means and the count from said character pulse counter for comparing the printing digit information digit by digit with the count of said character pulse counter to produce, upon coincidence therebetween, a coincidence signal and for applying each such coincidence signal to the single input terminal of said shift register while shifting the contents of said shift register upon each digit comparison; and a controller responsive to said selector means for enabling said shift register to store and shift the coincidence signals as the printing digit information.

5. A printer comprising:

a type body having a plurality of types;

a plurality of printing hammers arranged respectively to impact said plurality of types;

a group of hammer drivers for driving said plurality of hammers;

a serial-input and parallel-output type of shift register having respective output terminals connected to the respective hammer drivers for storing printing digit information to produce driving signals for the drivers;

flip-flops connected to the remaining output terminals of said shift register and responsive to the driving signals from the output terminals of said shift register for energizing one of said drivers; and a control circuit for causing said shift register to store and shift printing digit information for a succeeding printing line during a period of time while said flip-flops are set to enable the corresponding hammer drivers to permit the associated hammers to be driven.

6. A printer in accordance with claim 5, wherein the plurality of types are staggered in position relative to each other, said flip-flops being fewer in number than the output terminals of said shift register.

7. A printer in accordance with claim 5, wherein said type body is a cylindrical drum having types disposed on its outer periphery so that the types of a like character are staggered to assume different positions spaced circumferentially along the surface of the drum.

* * * * *